US006701651B1

(12) United States Patent
Crawford

(10) Patent No.: US 6,701,651 B1
(45) Date of Patent: Mar. 9, 2004

(54) SIGN KIT AND METHOD FOR ASSEMBLING A SIGN

(76) Inventor: Donald R. Crawford, 552 Knollridge, Copper Canyon, TX (US) 75067

( * ) Notice: Subject to any disclaimer, the term of this patent is extended or adjusted under 35 U.S.C. 154(b) by 255 days.

(21) Appl. No.: 09/138,063

(22) Filed: Aug. 21, 1998

(51) Int. Cl.[7] ..... G09F 19/00
(52) U.S. Cl. ..... 40/615; 40/124.191
(58) Field of Search ..... 40/746, 124.191, 40/780, 615, 124.19

(56) References Cited

U.S. PATENT DOCUMENTS

| | | | | | |
|---|---|---|---|---|---|
| 2,192,163 | A | * | 2/1940 | Metreger | 40/615 |
| 2,777,232 | A | * | 1/1957 | Kulicke et al. | 40/780 |
| 3,686,783 | A | * | 8/1972 | Levy | 40/746 |
| 4,090,464 | A | * | 5/1978 | Bishopp et al. | 40/615 X |
| 4,640,030 | A | * | 2/1987 | Wood et al. | 40/746 |
| 4,793,082 | A | | 12/1988 | Petrick et al. | 40/617 |
| 4,946,039 | A | | 8/1990 | Garran | 40/606 X |
| 4,947,566 | A | * | 8/1990 | Hoebel | 229/92.8 X |
| 4,953,780 | A | * | 9/1990 | Ross | 229/92.8 |
| 5,248,536 | A | * | 9/1993 | Du Katz | 40/615 X |
| 5,253,439 | A | * | 10/1993 | Shanok et al. | 40/746 X |
| 5,665,446 | A | * | 9/1997 | Sundet | 40/615 X |
| 5,699,956 | A | * | 12/1997 | Brennan | 229/92.8 |
| 5,735,453 | A | * | 4/1998 | Gick et al. | 229/92.8 |
| 5,918,394 | A | * | 7/1999 | Babcock | 40/124.19 |

* cited by examiner

*Primary Examiner*—Joanne Silbermann
(74) *Attorney, Agent, or Firm*—Philip G. Meyers

(57) ABSTRACT

A sign kit according to the invention includes a stiff backing in a predetermined size and a transparent cover sheet having dimensions sufficient to cover one face of the backing. Suitable means for mounting a sign, such as a built in stand or hanger, may be included along with a flexible sheet such as a sheet of paper printed on a front face thereof with sign information and adhered by a rear face thereof with an adhesive to a front face of the backing. The sign kit provides makes it possible to use desktop publishing, i.e., personal computers and software, to prepare professional quality signs in various sizes shapes and designs.

17 Claims, 1 Drawing Sheet

SIGN KIT AND METHOD FOR ASSEMBLING A SIGN

FIELD OF THE INVENTION

The invention relates to a kit for making small disposable signs generally intended for temporary uses.

BACKGROUND OF THE INVENTION

Commercial sign printers can only produce large lots of signs (e.g., 500–1000) cost effectively. For small scale uses or temporary signage, especially at trade shows where signs are a major expense, there is a need for a way to produce signs in small quantities without undue expense.

Various forms of temporary or removable sign kits are known. See, for example, Patrick et al. U.S. Pat. No. 4,793,082, and Garran U.S. Pat. No. 4,946,039. One commercially available sign kit made by 3M Corp. is essentially an oversize Post—It note. Die—cut cardboard signs are also known, as are stickers or adhesive signs. However, these known sign systems do not provide a practical means for making small numbers of signs for specific purposes. The present invention addresses this need.

SUMMARY OF THE INVENTION

A sign kit according to the invention includes a stiff backing in a predetermined size and a transparent cover sheet having dimensions sufficient to cover one face of the backing. Suitable means for mounting a sign, such as a built in stand or hanger, may be included. The kit may include materials for making only one sign or several signs, in the same or different sizes.

One preferred form of sign kit of the invention includes a stiff backing in a predetermined size, a transparent cover sheet having a transparent first adhesive on one side thereof and having dimensions sufficient to substantially cover one face of the backing, and a flexible sheet suitable for printing with a computer printer, such as a sheet of paper. A second adhesive secures the flexible sheet to the backing, which second adhesive is located on either the front face of the backing or the rear face of the flexible sheet. Suitable means for mounting the sign in a display position may be included.

According to another aspect of the invention, the sign kit includes a plurality of stiff backings in two or more predetermined sizes, such as standard paper sizes, and a plurality of transparent cover sheets in one or more sizes having dimensions sufficient to cover a front face of one or more the backings, such that each backing has a cover sheet of sufficient size to cover it. Suitable sign mounting means, if included, are provided one for each backing. Sheets of paper for printing may be omitted from this embodiment if the user supplies the paper as described hereafter.

Another sign kit according to the invention includes a stiff backing and a sheet of paper suitable for printing with a computer printer. The sheet of paper is lined on a rear face thereof with an adhesive suitable for attaching the paper to the backing and has a glossy finish on a front face thereof, which front is also suited for receiving printed images from a computer printer. As before, means for mounting the sign may be included. The high gloss on the front face of the paper takes the place of the transparent cover sheet.

The sign kit of the invention provides makes it possible to use desktop publishing, i.e., personal computers and software, to prepare professional quality signs in various sizes shapes and designs. Anyone owning a personal computer and desktop publishing or similar software has the ability to produce point-of-sale signs computer printed photos and frames, identification signs instructional signs, desktop and wall signs, computer-generated photos stand ups, business card stand ups and many other forms of display in the sign or digital photography fields.

A sign according to the invention which can be made using the foregoing kit includes a stiff backing, a flexible sheet printed on a front face thereof with sign information and adhered by a rear face thereof with a first adhesive to a front face of the backing, a sheet of transparent plastic cover material adhered by a rear face thereof with a second adhesive to a front face of the flexible sheet, and suitable means for mounting the sign in a display position. However, as described hereafter, a number of other finished signs also within the scope of the invention omit one or both of the adhesives, combine the backing and printed flexible sheet into a single element, or combine the printed sheet and the cover into a single element.

A method of making a sign according to the invention includes the successive steps of designing a sign message or graphic on a computer, printing out the sign message onto a front face of a flexible sheet, adhesively securing the sheet printed side out onto a stiff backing material, and adhesively securing a transparent cover sheet over the printed sheet.

BRIEF SUMMARY OF THE DRAWING

In the accompanying drawing, wherein like numbers represent like elements.

DETAILED DESCRIPTION

Figure 1:
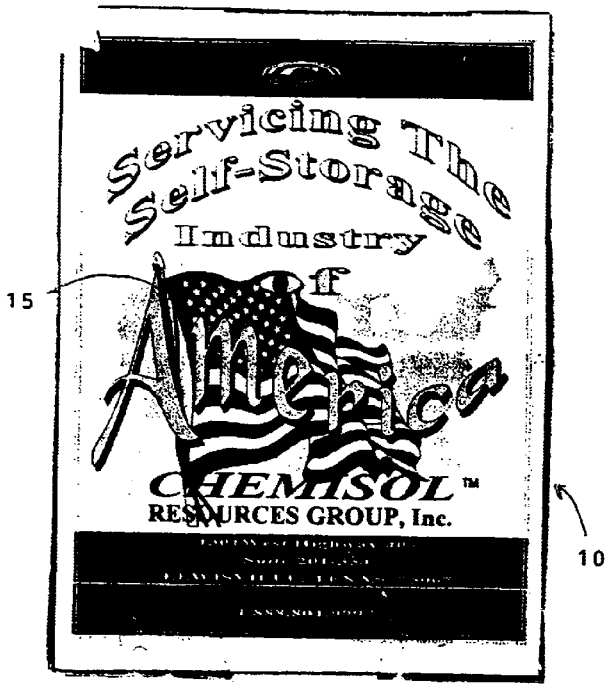
FIG. 1 is a front view of a sign made using the kit of the invention.
Figure 2:
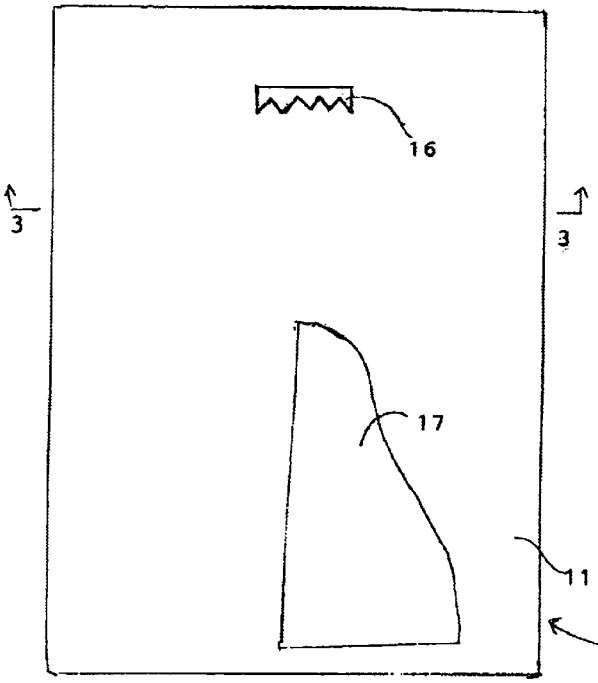
FIG. 2 is a rear view of the sign of FIG. 1.
Figure 3:
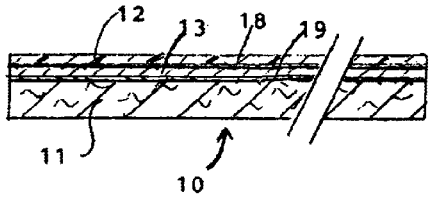
FIG. 3 is a cross-sectional view taken along the line 3—3 in FIG. 2.

Referring to FIGS. 1 to 3, a sign 10 according to the present invention includes a piece of stiff backing material 11, a piece of transparent cover material 12 having dimensions sufficient to cover one face of the backing material 11, a sheet of adhesive-lined paper 13 suitable for printing graphics 15 with a computer printer, and suitable means for placing the sign in a vertical display position, such as a stand 17 or hanger 16, or even a hole provided in backing 11. Backing 11 is most typically a square or rectangular piece of cardboard, foam board, paperboard or plastic. Transparent cover 12 is preferably a clear, self-adhesive plastic laminate (e.g., PET, PVC, polyethylene), preferably of the type sold commercially as JM laminating sheets. An adhesive layer 18 formed on the back of cover 12 is used to adhere cover 12 directly to the front face of sheet 13. Sheet 13 is a sheet of paper or similar printable material lined with an adhesive layer 19 that adheres it directly to the front face of backing 11, such as Avery adhesive labels presently available at office supply stores. Adhesive layers 18, 19 are covered with conventional releasable liners prior to use.

Referring to FIG. 2, the rear face of backing 11 may be provided with a diecut, fold-out hanger 16, a die-cut fold-out stand 17, or both. Sign 10 may then be placed in position for use by folding out stand 16, or by placing sign 10 on a wall or other vertical surface having a nail or picture hanger by means of hanger 16. In the alternative, other common commercially available stands or hanging devices may be used, such as adhesive squares that attach directly to a rear face of backing, 11 and to the support surface, such as a wall, or free-standing easel or picture holder.

A kit for making signs 10 according to the invention includes one or more sizes of backings 11. Since the paper used to print sheet 12 will typically be of a commercially available size, it is preferred to include in the kit one or more backings 11 in each of two or more standard paper sizes. For purposes of the invention, "standard paper sizes" means paper or other flexible sheet material in commercially available sizes ranging from 3 to 11 inches wide and 5 to 17 inches long, such as 3" by 5", A4, 8.5" by 11", 8.5" by 13", 11" by 17", and the like. A typical sign kit according to the invention includes one or more of each of two to four sizes of backings 11.

A number of pieces of paper or other flexible sheet material 13, generally matching or exceeding the number of backings 11 of like size, should be included in the kit if adhesively lined paper is to be used. The specific sizes of sheets 13 included with each kit will match the predetermined sizes of the backings 11, for example, if backings are rectangular pieces of cardboard having dimensions 8.5"×11" and 8.5"×13", at least a like number of adhesively-lined paper sheets 13 of both sizes are provided. In the alternative, if adhesive layer 17 is formed on backing 11 and covered with a releasable liner until the time of use, then ordinary paper supplied by the user could be used, and the kit need not include sheets 13.

The number of transparent plastic cover sheets 13 included in the kit will generally match or each exceed the number of backings 11. Such sheets 13 may be precut to the same standard size(s) as the backings 11, or only a single size of sheet 13 may be included which corresponds to the largest size backing. For smaller signs, the oversize sheet 13 is applied to the sheet 12 on backing 11 and the excess trimmed off with a knife, scissors, or single edged razor blade (e.g., an Exacto knife). The kit may further include such a trimming tool.

Figure 4:
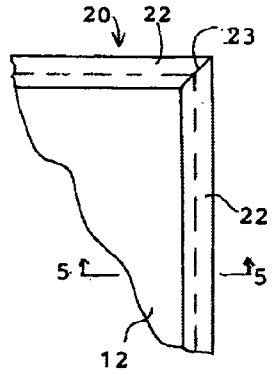
FIG. 4 is a partial front view, partly in phantom, of an alternative embodiment of a sign according to the invention.
Figure 5:
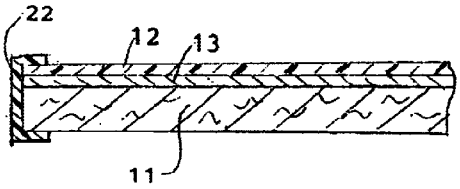
FIG. 5 is a cross-sectional view taken along the line 5—5 in FIG. 4.

Referring to FIGS. 4 and 5, a rectangular clip-on frame 20 comprises four plastic U-shaped edge pieces or frame sections 22 with angled ends 23 that form corners, so that four such pieces are clipped onto each side of a square or rectangular sign. One or more sets of frame sections 22 may be included in the kit according to the invention.

According to alternate forms of the invention, the adhesive may be omitted from one or both of cover 12 or paper 13. Paper 13 may, for example, have smaller length and width than cover 12 so that it is held placed by an adhesive margin of cover 12, and no adhesive 19 is needed. Adhesive 18 may then comprise a layer covering the entire rear face of cover 12, or cover 12 may have a central area free of adhesive in which paper 13 is placed. The rectangular adhesive margin of cover 12 holds both cover 12 and paper 13 to backing 11.

If both adhesive layers 18, 19 are omitted, cover 12 and paper 13 may be held in place at mutually superposed edges by frame 20. Cover sheet 12 may be omitted altogether if paper 13 is a high gloss paper such as Kodak ink jet snapshot paper that can receive printing on its glossy side directly from a computer printer. However, use of a transparent cover is preferred because it protects the paper from stains and physical damage and provides a more professional appearance.

According to the method of the invention, the user prints the desired sign on adhesively lined paper 13 and then adheres paper 13 to the backing 11. Transparent cover material 12 is then applied over and adheres directly to the front face of paper 13. Excess paper 13 or cover material 12 may be trimmed off with an Exacto knife as noted above, or the sign may be cut in any desired manner, such as along the irregular outline of a figure in a photograph.

The foregoing embodiments of the invention solve a number of problems currently facing many computer users. While software exists for the development of graphic materials that could be used to make signs, there is no available format for making a final product which can be displayed without going to a traditional printer for final production. The invention also solves the problem presented by unstable inks used in conventional ink jet printers. Covering the printed page with a clear transparent cover material provides a finished surface that is impermeable to water in most cases, and also has a professionally finished appearance required for a quality presentation. The sign kit of the invention further provides the user with the ability to rapidly produce signs and changes to signs at a fraction of the cost of traditional production methods, Unique signs can be produced without the waste involved in traditional printing runs.

It will be understood that the foregoing description is of preferred exemplary embodiments of the invention, and that the invention is not limited to the specific forms shown. For example, the flexible sheet and backing could be combined into a computer-printable sheet of stiff material, such as Bristol board, eliminating the need for an intermediate adhesive layer. Instead of a computer printer, a color copier could be used to transfer the images for the sign to the sheet. The cover sheet may be replaced by a transparent envelope formed by lamination which completely encapsulates the sign. These and other modifications may be made in the design and arrangement of the elements without departing from the scope of the invention as expressed in the appended claims.

What is claimed is:

1. A sign kit, comprising:

a stiff, square or rectangular backing in a predetermined size;

a transparent cover sheet having a transparent first adhesive on one side thereof and having dimensions sufficient to substantially cover one face of the backing;

a flexible sheet suitable for printing with a computer printer, which sheet has the same dimensions as the backing; and a second adhesive for securing the flexible sheet to the backing, which second adhesive is located on at least one of a front face of the backing and a rear face of the flexible sheet.

2. The sign kit of claim 1, wherein the flexible sheet is a sheet of paper in a size selected from 3 inches by 5 inches, A4, 8.5 inches by 13 inches, 8.5 inches by 13 inches and 11 inches by 17 inches.

3. The sign kit claim 1, wherein the cover sheet is a thin, flexible plastic sheet, the first adhesive is covered by a removable liner, the flexible sheet is a sheet of paper, and the second adhesive is covered by a removable liner.

4. The sign kit claim 1, further comprising a tool suited for trimming edges of the cover or the flexible sheet which exceed the dimensions of the backing.

5. The sign kit of claim 1, wherein the stiff backing is a square or rectangular piece of cardboard, foam board, or paperboard.

6. The sign kit of claim 1, further comprising means for mounting a sign in an upright display position.

7. The sign kit of claim 6, wherein the mounting means comprises a hanger.

8. The sign kit of claim 7, wherein the hanger is a flap on a rear face of the backing that folds out.

9. The sign kit of claim 6, wherein the mounting means comprises a stand.

10. The sign kit of claim 9, wherein the stand comprises a flap on a rear face of the backing that folds out.

11. A sign kit, comprising:

a stiff backing;

a sheet of paper suitable for printing with a computer printer, which sheet of paper is lined on a rear face thereof with an adhesive suitable for attaching the paper to the backing and has a glossy finish on a front face thereof, which front is also suited for receiving printed images from a computer printer; and means for mounting a sign.

12. The sign kit of claim 11, wherein the backing is square or rectangular and the sheet of paper is blank and has a size selected from 3 inches by 5 inches, A4, 8.5 inches by 11 inches, 8.5 inches by 13 inches and 11 inches by 17 inches.

13. A sign kit, comprising:

a stiff backing in a predetermined size;

a transparent cover sheet having a transparent first adhesive on one side thereof and having dimensions sufficient to substantially cover one face of the backing;

a flexible sheet suitable for printing with a computer printer; and a second adhesive for securing the flexible sheet to the backing, which second adhesive is located on at least one of a front face of the backing and a rear face of the flexible sheet, wherein the first and second adhesives are sufficient to bond the backing, cover and flexible sheet together in a permanent sign structure.

14. The sign kit of claim 13, wherein the flexible sheet is a blank piece of paper in a predetermined size selected from 3 inches by 5 inches, A4, 8.5 inches by 11 inches, 8.5 inches by 13 inches and 11 inches by 17 inches, and the backing is a square or rectangular piece of cardboard, paperboard, foam board or plastic.

15. The sign kit of claim 14, wherein the backing and the paper sheet have the same predetermined size.

16. The sign kit of claim 15, further comprising means for mounting a sign in an upright display position.

17. A sign kit, comprising:

a stiff backing;

a flexible sheet suitable for printing with a computer printer, which flexible sheet has a glossy finish on a front face thereof;

an adhesive for securing the flexible sheet to the backing, which adhesive is located on at least one of a front face of the backing and a rear face of the flexible sheet, wherein the adhesive is sufficient to bond the backing and flexible sheet together in a permanent sign structure; and means for mounting a sign.

* * * * *